US006026591A

United States Patent [19]

Zimmerman

[11] Patent Number: 6,026,591

[45] Date of Patent: Feb. 22, 2000

[54] VERTICAL SHAFT PROCESSOR WITH IMPROVED GAS DELIVERY SYSTEM

[75] Inventor: Robert V. Zimmerman, Denver, Colo.

[73] Assignee: Jones and Associates Engineers, Inc., Greeley, Colo.

[21] Appl. No.: 09/148,056

[22] Filed: Sep. 3, 1998

[51] Int. Cl.[7] ..... F26B 17/12

[52] U.S. Cl. ..... 34/175

[58] Field of Search ..... 34/171, 175, 178

[56] References Cited

U.S. PATENT DOCUMENTS 5,210,962 5/1993 Jones, Jr. .
5,366,170 11/1994 Jones, Jr. et al. .

*Primary Examiner*—Henry Bennett
*Assistant Examiner*—Malik N. Drake
*Attorney, Agent, or Firm*—Dorsey & Whitney LLP

[57] ABSTRACT

A vertical processing vessel includes an upper feed zone, an intermediate treatment zone and a lower removal zone, with the treatment zone including an improved system for distributing treating fluids uniformly across the cross-section of the vessel. The system provides for mutually perpendicular fluid distributing tubes which, in the preferred embodiment, has one set of tubes that extend completely across the vessel and a second set of perpendicular tubes that merely penetrate the wall of the vessel to deliver treating fluids along the perimeter of the vessel. The degree to which the delivery tubes in the second set penetrate the vessel is determined by the size of the vessel so that optimal conditions are attained for the delivery of the treating fluids.

14 Claims, 8 Drawing Sheets

VERTICAL SHAFT PROCESSOR WITH IMPROVED GAS DELIVERY SYSTEM

BACKGROUND OF THE INVENTION

1. Field of the Invention

The present invention relates generally to vertical processing vessels, which are commonly referred to as shaft or vertical kilns, shaft furnaces or shaft generators, depending upon the process for which the vessel is being used, and, more particularly, to an improved system for delivering treating fluid to the vessel.

2. Description of the Relevant Art

A common form of processing equipment found in diverse industrial applications is a vertical vessel, having a gravity flow of particulate solids from an upper feed to a lower discharge. Commonly, such vessels are called shaft or vertical kilns, shaft furnaces, shaft generators and the like, depending upon the application and particular type of material being treated. Such vessels have been found useful for burning or calcining treatment such as the calcining of various types of materials to produce lime, coking coal, burning magnesite and/or dolomite, retorting oil shale, etc. Such vessels commonly include a vertical vessel shell, means for uniformly feeding granular or pulverulent material across the lateral extend of the vessel, a lower discharge means for providing a uniform discharge of the solid material from the vessel shell and some means for introducing treating fluids into the solids so that the solid material is treated in accordance with the predesigned process. A prevalent issue in the proper functioning of such vessels is the uniform distribution of the treating fluids across the transverse cross-section of the vessel to obtain uniform treatment.

Typically, such vessels have main fluid delivery tubes extending laterally across the width of the vessel with spaced delivery nozzles along the length of the tubes. The tubes typically extend in parallel relationship along chords of the vessel. To compliment these main delivery tubes, secondary arcuate delivery tubes are sometimes mounted in the cylindrical wall of the vessel to deliver fluid along the perimeter of the vessel but the fluid from the arcuate delivery tubes sometimes will not penetrate far enough into the interior of the vessel to compliment the main delivery tubes.

It will, therefore, be appreciated that obtaining a uniform distribution of treating fluids across the interior of the vessel has been a problem which adversely affects the results of the treating system and it is to address this problem that the present invention has been developed.

SUMMARY OF THE INVENTION

A vertical shaft processor in accordance with the present invention includes a vertical vessel with means for controlling the movement by gravity of treated material therethrough and a unique system for delivering treating fluids uniformly across the transverse cross-section of the vessel for optimum results.

The treating system includes first and second sets of fluid delivery tubes which communicate with the interior of the vessel and such that the tubes in one set are substantially perpendicular to the tubes in a second set. In one preferred embodiment where the vessel is of circular cross-section, the first set of tubes, which are referred to as the main delivery tubes, extend across the vessel along chords of the vessel and have a plurality of fluid discharge openings or nozzles along their length. The delivery tubes in the second set, which are referred to as the secondary delivery tubes, project into the interior of the vessel like probes from exteriorly thereof but the degree to which the secondary tubes project into the vessel is selectable so as to assure that the treating fluid fills the spaces around the perimeter of the vessel radially outwardly of the main delivery tubes. The secondary delivery tubes will normally project varying distances into the interior of the vessel and have nozzles on their innermost ends through which the treating fluid is injected into the vessel. The nozzle size is regulated so that the treating fluid emanating therethrough not only moves forwardly toward fluid delivered from the nearest main delivery tube but also flows rearwardly toward the cylindrical wall of the vessel.

The main and secondary delivery tubes can be presented in one or more layers depending largely on the height of the vessel. The degree to which the secondary delivery tubes penetrate the vessel is dependent upon the width of the vessel so that the system is universally adaptable to any sized vessel for uniformly delivering treating fluid across the transverse cross-section of the vessel.

Other aspects, features and details of the present invention can be more completely understood by reference to the following detailed description of the preferred embodiment, taken in conjunction with the drawings, and from the appended claims.

DESCRIPTION OF THE PREFERRED EMBODIMENTS

Figure 1:
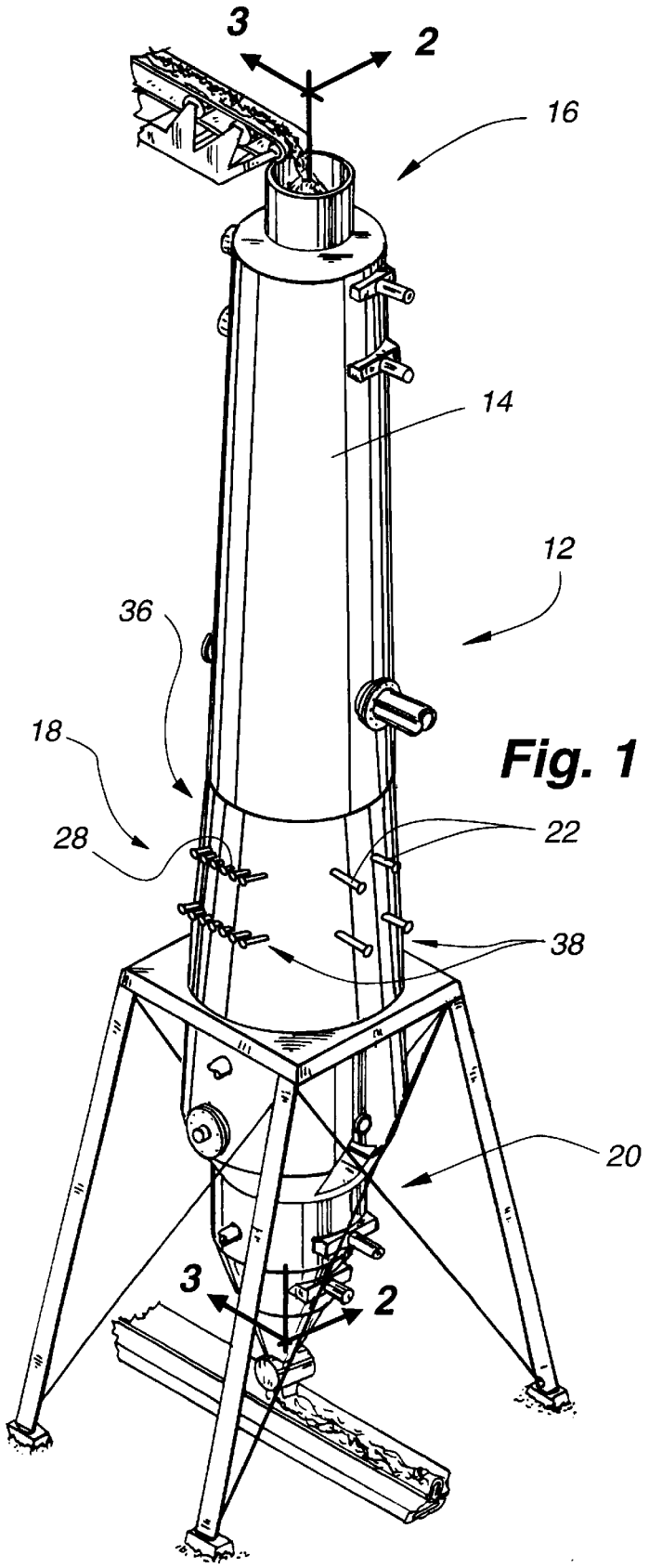
FIG. 1 is an isometric of a vertical shaft processor incorporating the treating system of the present invention.

The vertical shaft processor or vessel 12 of the present invention, as seen in FIG. 1, finds use in many known fields of endeavor. For purposes of the present disclosure, the various processes which may be practiced with the vessel will not be described in detail. A common feature of these processes, however, resides in the fact that a particulate material to be treated or processed is introduced to the vessel at the top thereof and flows by gravity as a moving bed through the vessel, where it is exposed to a counter-flow of treating fluid, such as combustible gas, before it is removed from the bottom of the vessel. Depending upon the process being practiced within the vessel, the particulate material itself will vary, as will the treating fluids, which may be gas or liquid. Certain gas-treating fluids may be combustible to obtain elevated temperatures in the practice of certain processes.

In the disclosed embodiment, the processor comprises a vertical and substantially cylindrical wall or shell 14 having an upper feed zone 16, an intermediate treatment zone 18 and a lower removal zone 20. It will be appreciated, however, from the description that follows that the vessel could have various cross-sectional configurations without adversely affecting the functioning of the present invention. Details of what might exist in the shell for controlling the movement of the particulate material through the vessel and how it might be discharged from the vessel are found in U.S. Pat. Nos. 5,366,170 and 5,210,962, which are hereby incorporated by reference.

Figure 2:
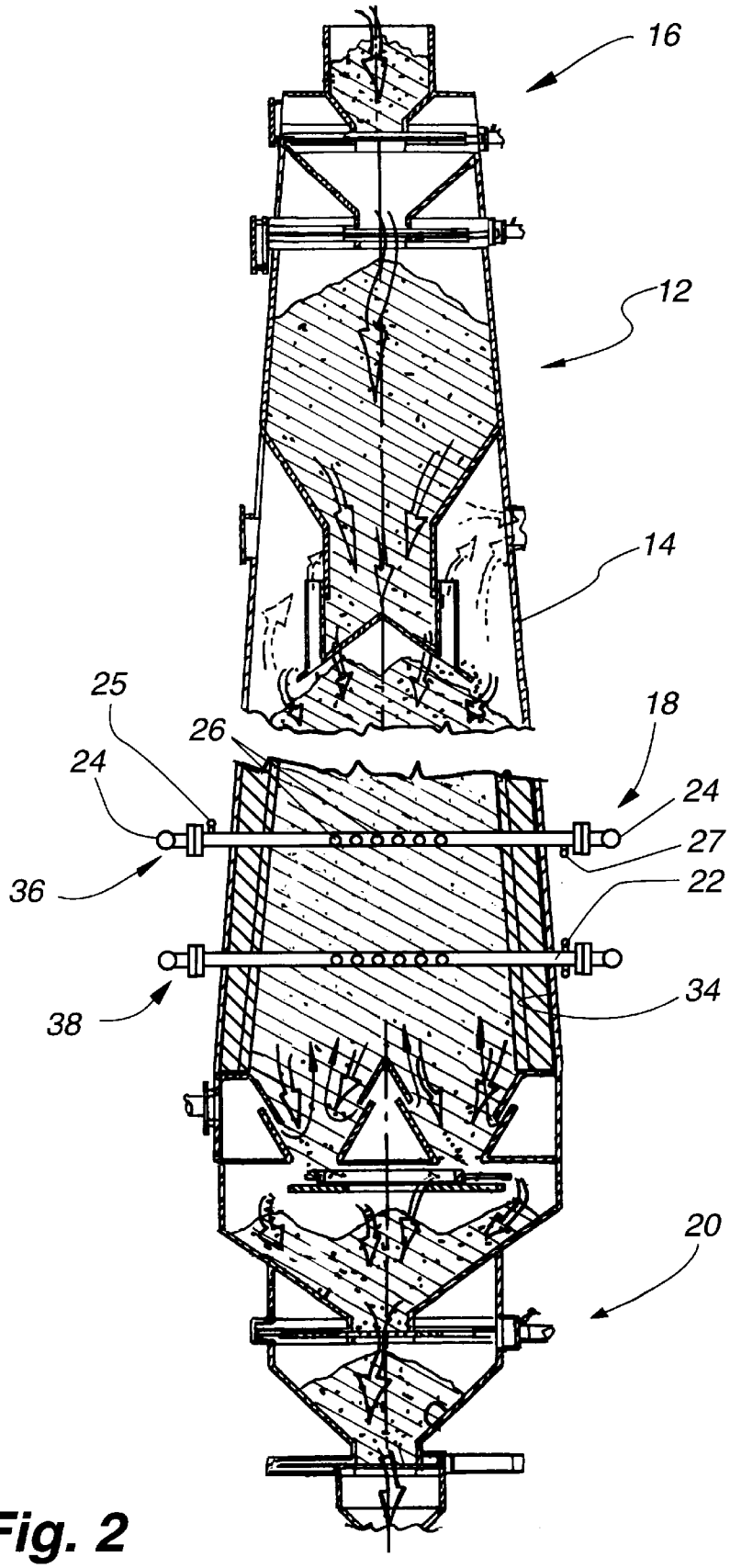
FIG. 2 is an enlarged section taken along line 2—2 of FIG. 1.
Figure 3:
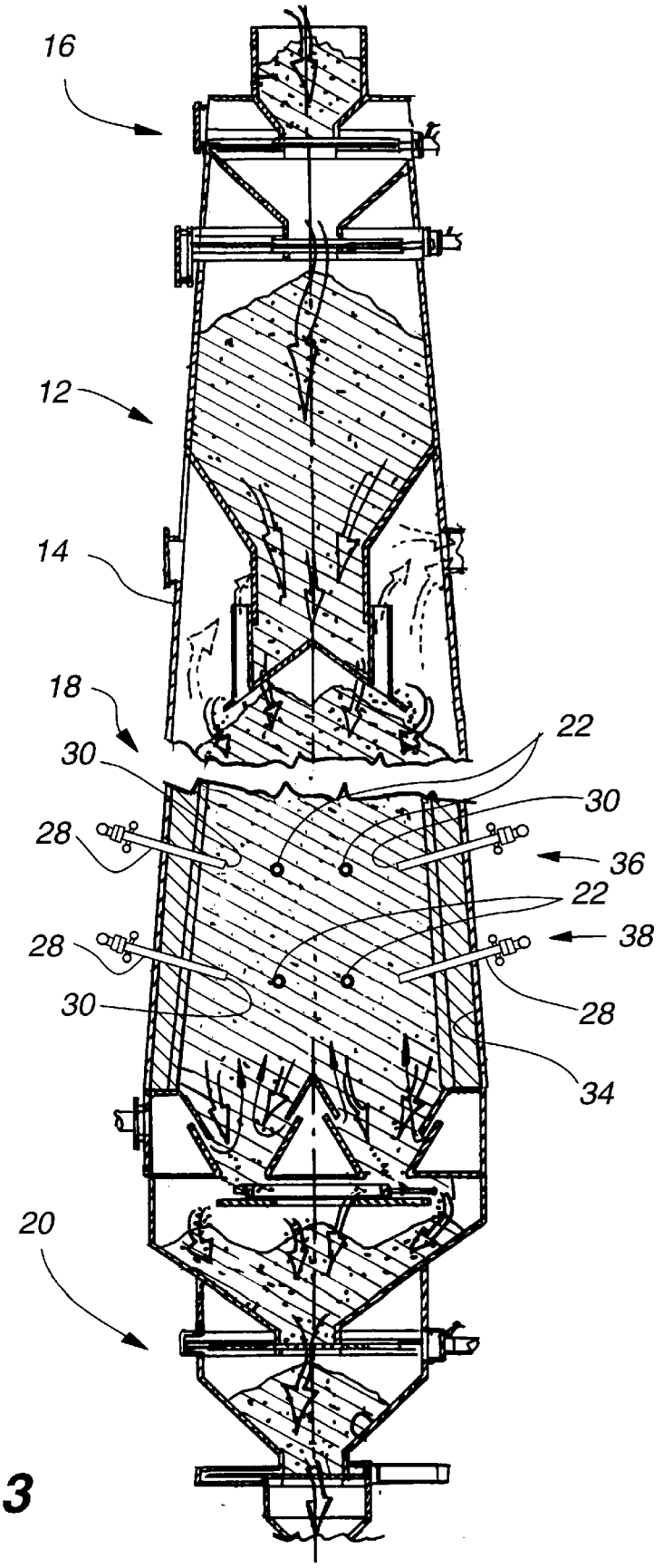
FIG. 3 is an enlarged section taken along line 3—3 of FIG. 1.

The gas delivery system of the present invention for treatment of the particulate material is positioned in the intermediate treatment zone 18 of the processor and consists of a plurality of fluid distribution tubes that communicate with the interior of the vessel in the treatment zone. As seen in FIGS. 1–3, there are two sets of fluid distribution tubes, with the first or main set consisting of a plurality of parallel tubes 22 that each extend along a chord of the vessel from one side to the other while extending through opposite sides of the vessel, in sealed relation therewith, for connection to treating fluid manifolds 24. In the disclosed embodiment, there are two such main chordal delivery tubes 22 in the set, even though this number would vary depending upon the diameter of the vessel 12 as will become more clear later. The main delivery tubes include concentric cylinders as disclosed in the aforenoted U.S. Pat. No. 5,210,962 which has been incorporated by reference and have a plurality of discharge openings 26 along their length with the openings being substantially equally spaced and directed out of two sides of the delivery tube for uniform distribution of the treating fluids through the associated delivery tube. As will be appreciated, treating fluid is introduced to the innermost one (not shown) of the concentric cylinders of the main delivery tubes from the manifold 24 at each end of the tubes. Coolant for the main delivery tubes is introduced to the outermost one of the concentric cylinders (not shown) at one end through a supply manifold 25 and removed therefrom through a return manifold 27 at the other end of the delivery tubes.

A second or secondary set of delivery tubes 28 includes tubes or probes which are each disposed in a vertical plane that is perpendicular to the main delivery tubes 22 and the secondary delivery tubes 28 comprise shorter length tubes that project through the wall 14 of the vessel, in a sealed relation therewith, so as to have an open longitudinal end 30 within the interior of the vessel. The secondary tubes are inclined downwardly in the inward direction so that the open end 30 of the tube is not facing the line of movement of particulate material through the vessel which might otherwise block or clog the opening. The open ends, as will be described in more detail later, have nozzles 32 placed therein with the size of the nozzle being predetermined for a particular sized vessel. The secondary delivery tubes are provided in pairs with the delivery tubes in a pair being on opposite sides of the vessel 12 in confronting relationship and in a common vertical plane.

Figure 6:
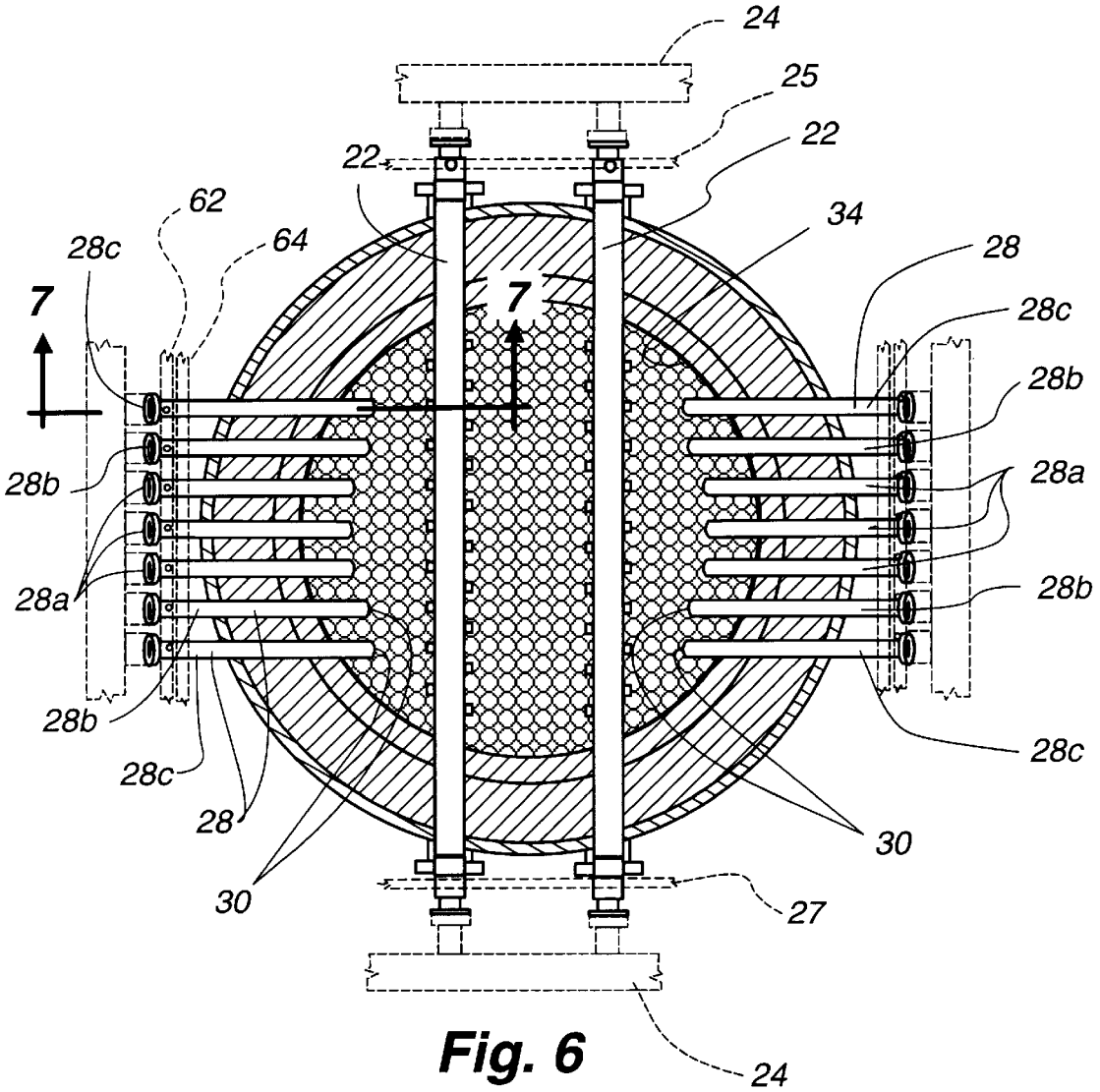
FIG. 6 is an enlarged section taken along line 6—6 of FIG. 1.
Figure 7:
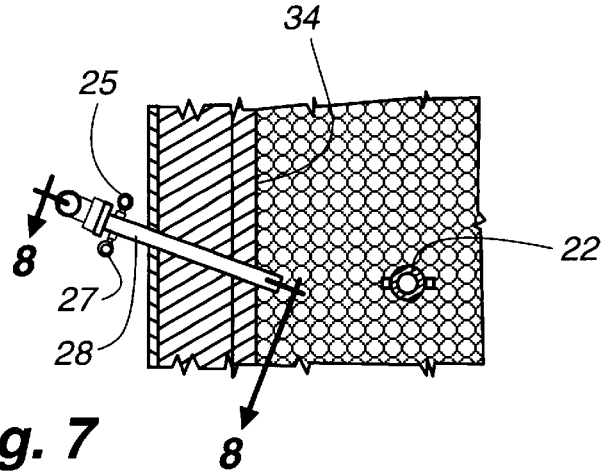
FIG. 7 is a fragmentary section taken along line 7—7 of FIG. 6.

The vertical plane of each secondary delivery tube 28 extends along a chord of the vessel similarly to the main delivery tubes 22 except perpendicular thereto. The secondary delivery tubes have varying lengths with the length of each delivery tube being determined by the diameter of the vessel 12 so that the treating fluid being delivered through the tube compliments the treating fluid delivered through the main delivery tubes to obtain a uniform distribution of the treating fluid across the transverse cross-section of the vessel. In the vessel disclosed in the present invention, and as best seen in FIG. 6, there are seven pairs of secondary delivery tubes 28 in the second set with the three delivery tube pairs 28*a* at the center of the set being of equal length, the two next outermost delivery tube pairs 28*b* being slightly longer, and the two outermost delivery tube pairs 28*c* being the longest. It will be appreciated, however, that even though some secondary delivery tubes are longer than others, their nozzles 32 are closer to the inner surface 34 of the wall 14 of the vessel than the shorter tubes and are, as well, closer to the nearest main delivery tube as this arrangement has been found to provide an optimum and uniform distribution of treating fluids across the transverse cross-section of the vessel. In other words, the delivery tubes 28 are adapted to deliver treating fluids at different radial distances from the central longitudinal axis of the shell.

As mentioned previously, the openings 26 in the main delivery tubes 22 are angled downwardly from opposite sides of the tubes similarly to the angle of the secondary delivery tubes 28 so that particulate matter flowing through the vessel does not block or clog the nozzles thereby inhibiting the free flow of treating fluid therethrough. Further, it will be appreciated that, depending upon the diameter of the vessel, there may be fewer or more main delivery tubes 22 than pairs of secondary delivery tubes 28.

As can be appreciated in FIGS. 1, 2 and 3, the embodiment of the vessel disclosed therein shows two layers of main and secondary delivery tubes with each layer being identical such that the main delivery tubes 22 in the top layer 36 are parallel to the main delivery tubes 22 in the bottom layer 38 and similarly, the secondary delivery tubes 28 in the top layer 26 are parallel with the secondary delivery tubes 28 in the lower layer 38. Obviously, depending upon the height of the vessel, additional layers of delivery tubes can be provided but for purposes of illustration, two such layers are illustrated and their spacing is determined by the particular process for which the vessel is being used. Also, while the vessel 12 is substantially cylindrical, it does have a slight conical configuration so that the number of main or secondary delivery tubes in one layer might be different from the number in a different layer due to the difference in diameter of the vessel at the level of the different layers.

Figure 4:
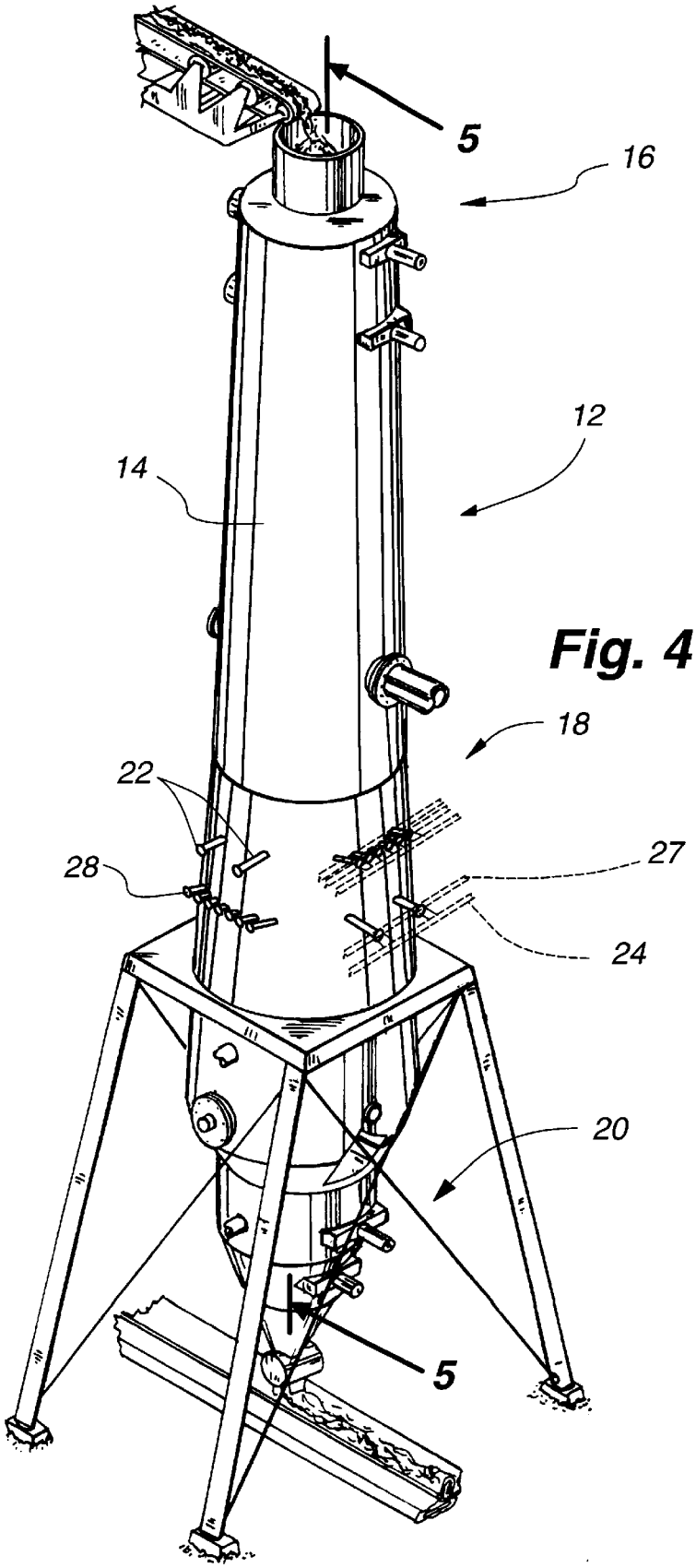
FIG. 4 is an isometric of a vertical shaft processor incorporating an alternative arrangement to the treating system disclosed in the vessel of FIG. 1.
Figure 5:
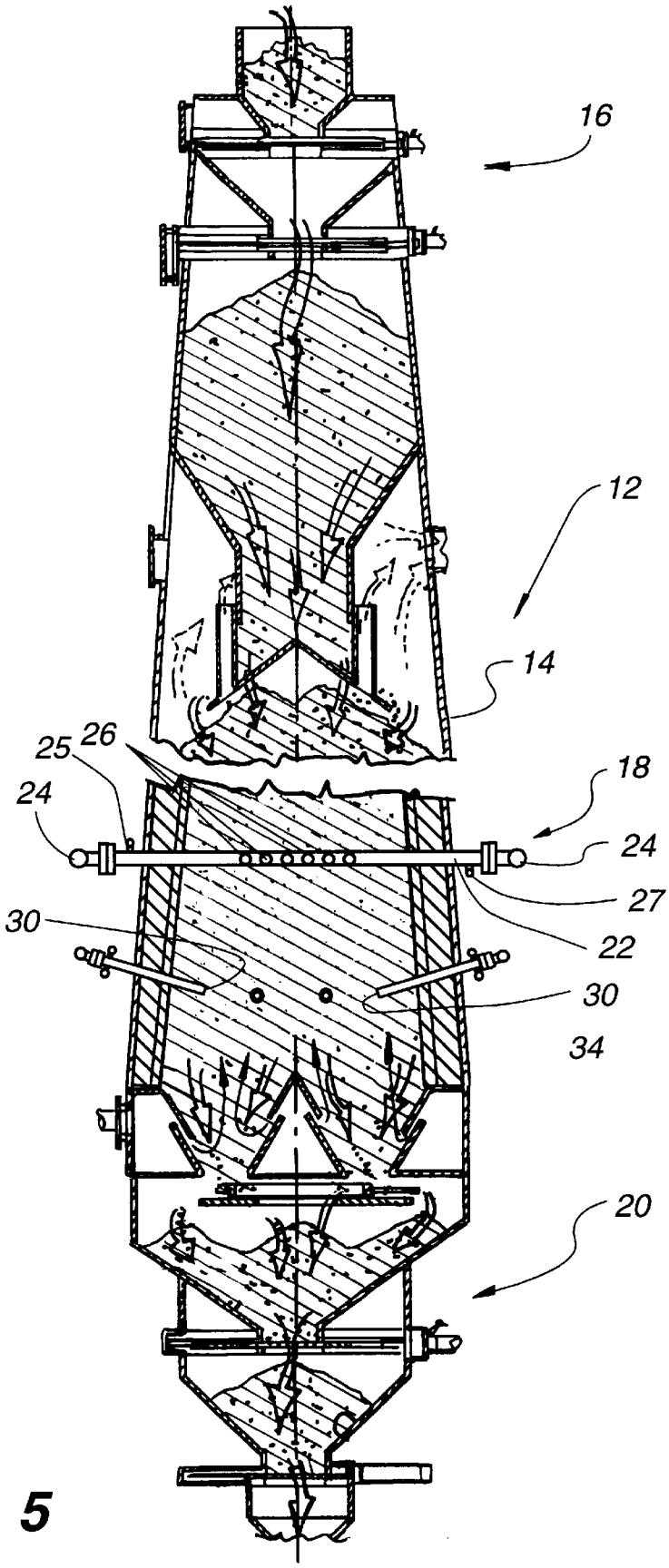
FIG. 5 is an enlarged section taken along line 5—5 of FIG. 4.

Referring to FIGS. 4 and 5, an alternate system for delivering treating fluids is disclosed even though the components of the vessel and the delivery tubes, themselves, are identical. It is only the placement of the delivery tubes that has been modified. In the embodiment disclosed in FIGS. 4 and 5, there are again main 22 and secondary 28 delivery tubes that are identical to the main and secondary delivery tubes disclosed in the first described embodiment positioned in a first or upper layer 36, and a second layer 38 of the delivery tubes identical to the upper layer provided therebeneath but wherein the arrangement of the delivery tubes in the lower layer has been rotated 90 degrees so that the main delivery tubes in the top layer extend substantially parallel to the secondary delivery tubes in the lower layer and, vice versa, the secondary delivery tubes in the top layer extend substantially parallel to the main delivery tubes in the lower layer. This is simply a variation of the embodiment shown in FIG. 1 and, again, provides uniform distribution of the treating fluids across the transverse cross-section of the vessel.

Figure 8:
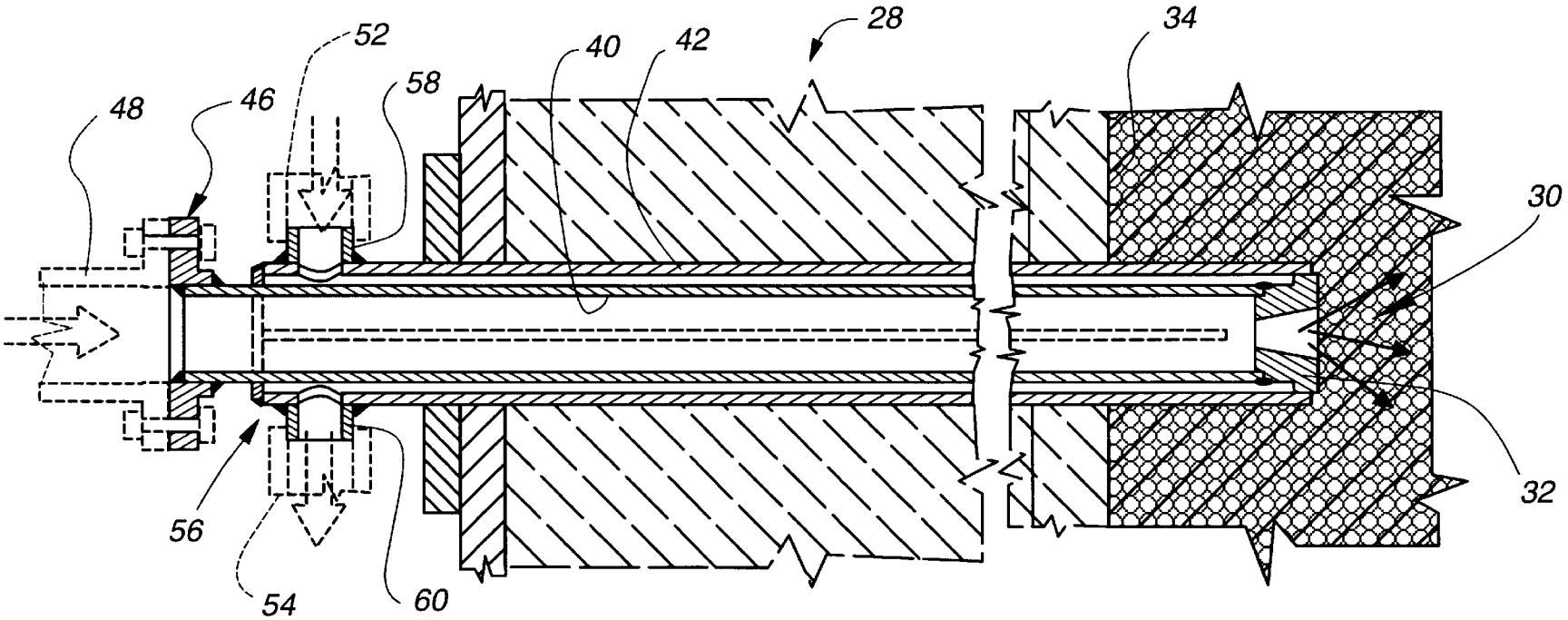
FIG. 8 is an enlarged fragmentary section taken along line 8—8 of FIG. 7.
Figure 9:
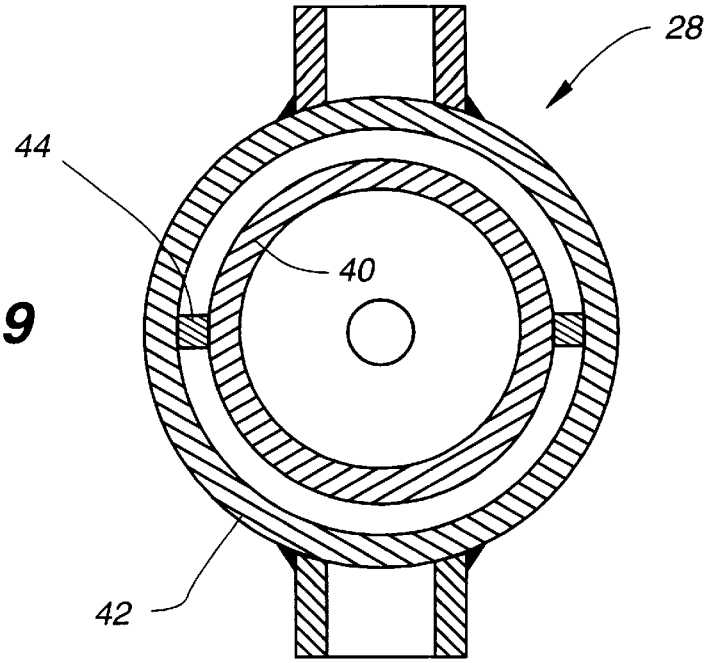
FIG. 9 is an enlarged section taken along line 9—9 of FIG. 8.
Figure 10:
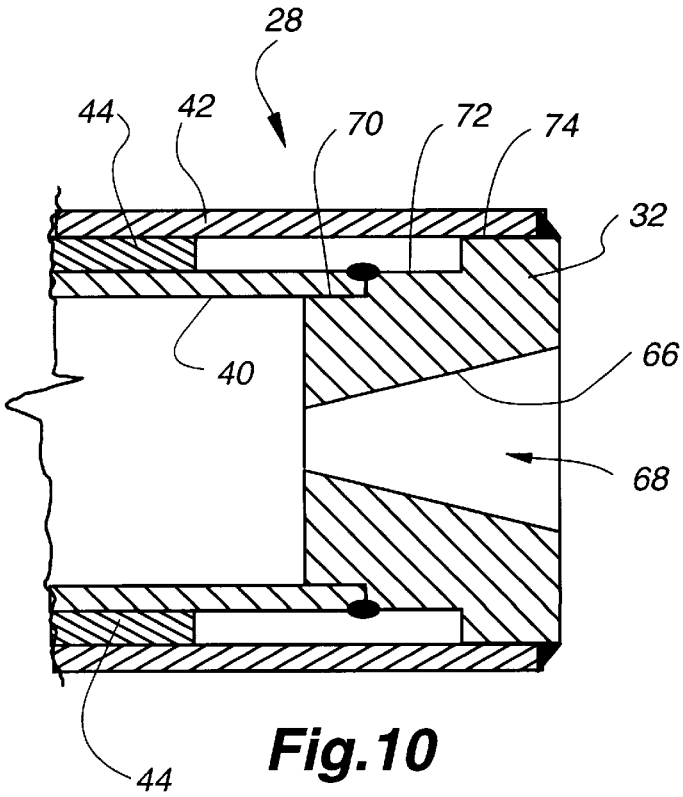
FIG. 10 is an enlarged fragmentary section taken along line 10—10 of FIG. 8.
Figure 11:
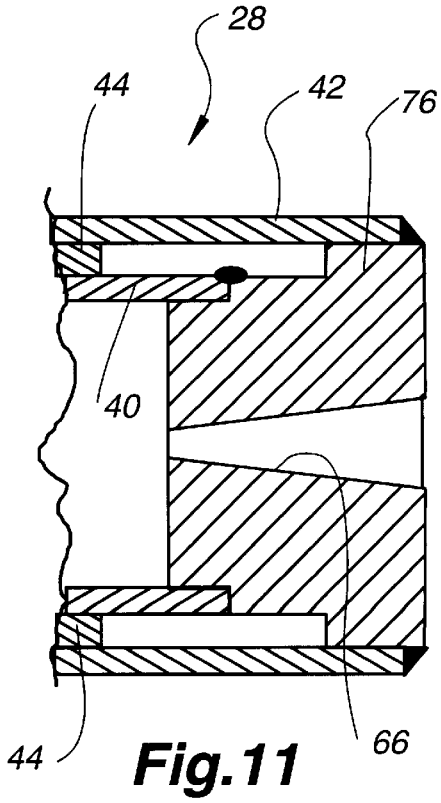
FIG. 11 is an enlarged fragmentary section similar to FIG. 10 showing a smaller sized nozzle.

Looking next at FIG. 8, a secondary delivery tube 28 is illustrated and can be seen to comprise inner 40 and outer 42 concentric cylinders which are retained in spaced relationship by a pair of diametrically opposed longitudinally extending radial dividers 44 which are best seen in FIGS. 9 through 11. The inner cylinder 40 is for the delivery of treating fluid and has its outermost end connected through interconnected flanges 46 to a delivery neck 48 of a treating fluid manifold 24. In this manner, uniform amounts of treating fluid are delivered from the manifold to the inner cylinder of each connected secondary delivery tube so that the treating fluid is delivered to the interior of the vessel 12 uniformly. The outer cylinder 42 is a cooling cylinder and is connected at its outermost end to a coolant supply 52 and a coolant return 54 by a connector 56 having an upwardly projecting neck 58 for connection to the coolant supply and a downwardly projecting neck 60 for connection to the coolant return. The radial dividers 44 that retain the spacing between the inner and outer cylinders run substantially the full length of the secondary delivery tube but terminate short of the innermost end of the tube 28 so that coolant fluid being delivered through the upwardly projecting neck 58 is forced to run along the upper half of the delivery tube and then circulate around the innermost end of the inner cylinder before being returned along the lower half of the tube to the coolant return 54. The supply and return necks 58 and 60 respectively for the cooling system are also connected to delivery and exhaust manifolds 62 and 64 respectively in a conventional manner with the manifolds being shown in FIGS. 4–7. As mentioned previously, the main delivery tubes 22 also have inner and outer cylinders which are not shown but would be interconnected similarly to the cylinders in the secondary tubes. The interior of the main delivery tube has not been illustrated but from the above description of the secondary delivery tubes it is felt to be within the skill of one skilled in the art.

The nozzle 32 on each secondary delivery tube 28 has an inwardly divergent frustoconical surface 66 defining a passage 68 therethrough through which the treating fluids are delivered to the interior of the vessel. The outer perimeter of the nozzle has three cylindrical walls 70, 72 and 74 with the innermost 70 and outermost 74 cylindrical walls being hermetically sealed to the inner and outer cylinders 40 and 42 respectively of the associated secondary delivery tube. In this manner, the coolant fluid is confined within the space between the inner and outer cylinders while the treating fluid is allowed to pass through the inner cylinder 40 and the nozzle 32. The connection of the nozzle to the innermost end of the associated secondary delivery tube is seen in an enlarged view in FIG. 10 and with an alternative-sized nozzle 76 in FIG. 11.

The size of the nozzle openings are varied depending upon the size of the vessel 12 and the degree to which the secondary delivery tubes 28 project into the interior of the vessel. It has been found that the larger the opening in the nozzle, the slower the fluid will be delivered to the vessel and the more the fluid will back flow as it enters the vessel so as to spread toward the inner surface 34 of the wall of the vessel while also moving inwardly toward the nearest main delivery tube 22. Accordingly, if the inner end of the secondary delivery tubes were close to the inner surface 34 of the vessel, the nozzle opening might be selected to be smaller as the amount of back flow would not be as important, whereas if a secondary delivery tube projected a greater distance into the vessel, the size of the discharge opening might be larger to allow a greater back flow which would spread rearwardly toward the wall of the vessel for uniform distribution of the treating fluid.

It will be appreciated with a system of the type described that, depending upon the size of the vessel, a plurality of the main delivery tubes 22 will extend completely across the vessel and will deliver treating fluid to the bulk of the cross-sectional area of the vessel. The secondary delivery tubes 28 are more or less fine tuning delivery tubes which deliver fluid in the areas around the perimeter of the vessel where fluid from the main delivery tubes do not readily reach. It will also be appreciated that the secondary delivery tubes, while being fixed to the wall of the vessel, can be of any desired length and can be made to penetrate the vessel to any desired degree depending upon the size of the vessel so that uniform distribution of gas in the vessel can be achieved with any diameter of vessel.

Although the present invention has been described with a certain degree of particularity, it is understood that the present disclosure has been made by way of example, and changes in detail or structure may be made without departing from the spirit of the invention as defined in the appended claims.

I claim:

1. A vertical shaft processor comprising in combination, a substantially cylindrical shell having an inner wall, processing means in said shell for treating materials that flow by gravity through said shell and a discharge opening for the discharge of treated materials, said processing means including, first and second sets of treating fluid delivery tubes penetrating said cylindrical shell so as to communicate with the interior of said shell, said delivery tubes in the first set each lying in a vertical plane that is substantially perpendicular to the vertical planes containing each delivery tube of the second set, and the delivery tube of each set including at least one opening through which treating fluids can be delivered to the interior of said cylindrical shell, the delivery tubes in said second set constituting individual tubes projecting into said shell different distances with each tube in the second set delivering treating fluids independently of the other tubes in the second set at various radial distances from the central longitudinal axis of said shell.

2. The processor of claim 1 wherein said delivery tubes of the first set extend along chords of said substantially cylindrical shell and completely across the width of said shell and said delivery tubes of the second set extend across less than the width of said substantially cylindrical shell.

3. The processor of claim 2 wherein said delivery tubes of the first set are in a common plane with the delivery tubes of the second set.

4. The processor of claim 3 wherein there are two layers of said delivery tubes of the first and second sets.

5. The processor of claim 2 wherein said delivery tubes of the second set comprise a plurality of pairs of delivery tubes with the delivery tubes of a pair being opposed to each other on opposite sides of said substantially cylindrical shell.

6. The processor of claim 5 wherein each pair of delivery tubes in the second set lies in a common vertical plane.

7. The processor of claim 6 wherein said delivery tubes in the second set have said opening in the longitudinal end thereof.

8. The processor of claim 1 wherein said delivery tubes have inner and outer concentric passages along their length, one of said passages being provided for the delivery of said treating fluid and the other of said passages for a coolant fluid.

9. The processor of claim 1 wherein said at least one opening includes a nozzle of a predetermined size.

10. The processor of claim 9 wherein said nozzles are sized to deliver treating fluids in uniform quantities across the width of said substantially cylindrical shell.

11. The processor of claim 10 wherein there are a plurality of openings along the length of said delivery tubes of the first set.

12. The processor of claim 11 wherein there are a greater number of delivery tubes in the first set than pairs of delivery tubes in the second set.

13. The processor of claim 11 wherein there are a smaller number of delivery tubes in the first set than pairs of delivery tubes in the second set.

14. A vertical shaft processor comprising in combination, a substantially cylindrical shell having an inner wall, processing means in said shell for treating materials that flow by gravity through said shell and a discharge opening for the discharge of treated materials, said processing means including, first and second sets of treating fluid delivery tubes penetrating said cylindrical shell so as to communicate with the interior of said shell, said delivery tubes in the first set each lying in a vertical plane that is substantially perpendicular to the vertical planes containing each delivery tube of the second set, and the delivery tubes of each set including at least one opening through which treating fluids can be delivered to the interior of said interior shell, said delivery tubes of the first set extending along cords of said substantially cylindrical shell and completely across the width of said shell and said delivery tubes of the second set extending across less than the width of said substantially cylindrical shell, said delivery tubes of the first set being in a common plane with the delivery tubes of the second set, there being two layers of said delivery tubes of the first and second sets and wherein said delivery tubes of the first and second sets in one layer are oriented at a 90° angle respectively from the delivery tubes of the first and second sets in the other layer.

* * * * *